US007140918B1

(12) United States Patent
Delaney et al.

(10) Patent No.: US 7,140,918 B1
(45) Date of Patent: Nov. 28, 2006

(54) SHIELDED ELECTRICAL CONNECTOR FOR MOUNTING ON A CIRCUIT BOARD

(75) Inventors: Kevin Delaney, Ennis Clare (IE); Colin Patrick Hehir, Clare (IE); Mike O'Halloran, Clare (IE); David Walsh, Co. Dublin (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/198,775

(22) Filed: Aug. 5, 2005

(51) Int. Cl.
*H01R 13/648* (2006.01)

(52) U.S. Cl. ..... 439/607; 439/910; 439/83

(58) Field of Classification Search ..... 439/607–610, 439/910, 83
See application file for complete search history.

(56) References Cited

U.S. PATENT DOCUMENTS 5,290,177 A * 3/1994 Chal ..... 439/610
5,637,015 A * 6/1997 Tan et al. ..... 439/607
5,886,879 A 3/1999 Matuschik
5,894,726 A * 4/1999 Monnier ..... 60/274
5,984,726 A 11/1999 Wu
6,059,581 A * 5/2000 Wu ..... 439/79
6,186,830 B1 * 2/2001 Lin et al. ..... 439/607
6,203,373 B1 * 3/2001 Lin ..... 439/607
6,210,224 B1 * 4/2001 Wu ..... 439/607
6,364,700 B1 * 4/2002 Zhu et al. ..... 439/567
6,383,024 B1 * 5/2002 Wang et al. ..... 439/607
6,447,311 B1 * 9/2002 Hu et al. ..... 439/108
6,814,612 B1 * 11/2004 Hu et al. ..... 439/541.5
6,837,742 B1 * 1/2005 Chou et al. ..... 439/541.5
2001/0049227 A1 * 12/2001 Zhu et al. ..... 439/607
2002/0086581 A1 * 7/2002 Chen et al. ..... 439/607
2002/0142656 A1 * 10/2002 Chang ..... 439/607

* cited by examiner

*Primary Examiner*—Gary F. Paumen
(74) *Attorney, Agent, or Firm*—Stephen Z. Weiss

(57) ABSTRACT

A shielded electrical connector is provided for mounting on a printed circuit board. The connector includes a dielectric housing for mounting on the circuit board and including a front mating end and a rear terminating end. A plurality of conductive terminals are mounted on the housing. A metal shield surrounds the dielectric housing. The shield has an opening at the rear of the housing to afford visual inspection of the connections between the tail portions of the terminals and the circuit traces on the circuit board. A shield cover is slidably mounted at the rear of the housing and the shield to slidably close the opening in the metal shield in a direction generally perpendicular to the printed circuit board.

18 Claims, 3 Drawing Sheets

SHIELDED ELECTRICAL CONNECTOR FOR MOUNTING ON A CIRCUIT BOARD

FIELD OF THE INVENTION

This invention generally relates to the art of electrical connectors and, particularly, to a shielded electrical connector for mounting on a printed circuit board.

BACKGROUND OF THE INVENTION

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The interengaging terminals of the connectors, themselves, may be male and female terminals.

Some electrical connectors are shielded connectors. In other words, the mating interface of a connector (i.e., where the terminals of the connector mate or engage the terminals of the mating connector) is surrounded by a conductive shield, cover or shroud which typically is fabricated of metal material and provides for EMI and RFI protection. The shield preferably covers the termination area of the connector.

Some electrical connectors are designed for mounting on a printed circuit board. The terminals of the connector have tail portions for connection, as by soldering, to appropriate circuit traces on the circuit board. It is desirable to be able to inspect the solder connections to ensure that there are good solder joints formed between the connector terminals and the circuit traces on the board. Unfortunately, problems are encountered with shielded connectors of the character described above, because a portion of the shield must be open to allow for such inspections. When there is considerable electromagnetic interference, this opening must be closed after inspection. It has been proposed to close the opening, which typically is at the rear of the connector, by a shield cover or door which slidably moves generally parallel to the printed circuit board. However, this creates additional problems because, to allow the shield door to move parallel to the circuit board, valuable space or "real estate" must be provided rearwardly of the connector. With the ever-increasing miniaturization of such electronic apparatus, this lost space on the circuit board is very costly. The present invention is directed to solving these various problems.

SUMMARY OF THE INVENTION

An object, therefore, of the invention is to provide a new and improved shielded electrical connector for mounting on a printed circuit board.

In the exemplary embodiment of the invention, the connector includes a dielectric housing for mounting on the circuit board and including a front mating end and a rear terminating end. A plurality of conductive terminals are mounted on the housing and include contact portions at the mating end of the housing for engaging appropriate contacts of a complementary mating connector. The terminals have tail portions at the terminating end of the housing for connection to appropriate circuit traces on the printed circuit board. A metal shield substantially surrounds the dielectric housing and, particularly, the mating end thereof. The shield has an opening at the rear of the housing to afford visual inspection of the connections between the tail portions of the terminals and the circuit traces on the circuit board. A shield cover is slidably mounted at the rear of the housing and the metal shield to slidably close the opening in the metal shield in a direction generally perpendicular to the printed circuit board.

According to one aspect of the invention, grooves are provided at opposite sides of the opening for slidably receiving opposite side edges of the shield cover. As disclosed herein, the grooves are formed between the housing and the metal shield. The shield cover includes spring tabs at the opposite side edges thereof for positively engaging the metal shield to improve electrical interengagement therewith.

According to another aspect of the invention, stop means are provided to limit the depth of insertion of the cover into the grooves and to define a closed position of the shield cover slightly above the printed circuit board. As disclosed herein, the stop means include laterally extending stop tabs on the shield cover for engaging one of the housing or the metal shield to define the depth of insertion of the cover into the grooves.

According to a further aspect of the invention, latch means are provided to hold the shield in position closing the opening in the metal shield. As disclosed herein, the latch means comprise interengaging latch means between the shield cover and the metal shield, and particularly a latch tab on the metal shield projecting over a top edge of the shield cover.

Finally, a feature of the invention includes a bottom edge of the shield cover being flared outwardly relative to the connector. This prevents the shield cover from engaging tail portions of ground terminals which may project rearwardly of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
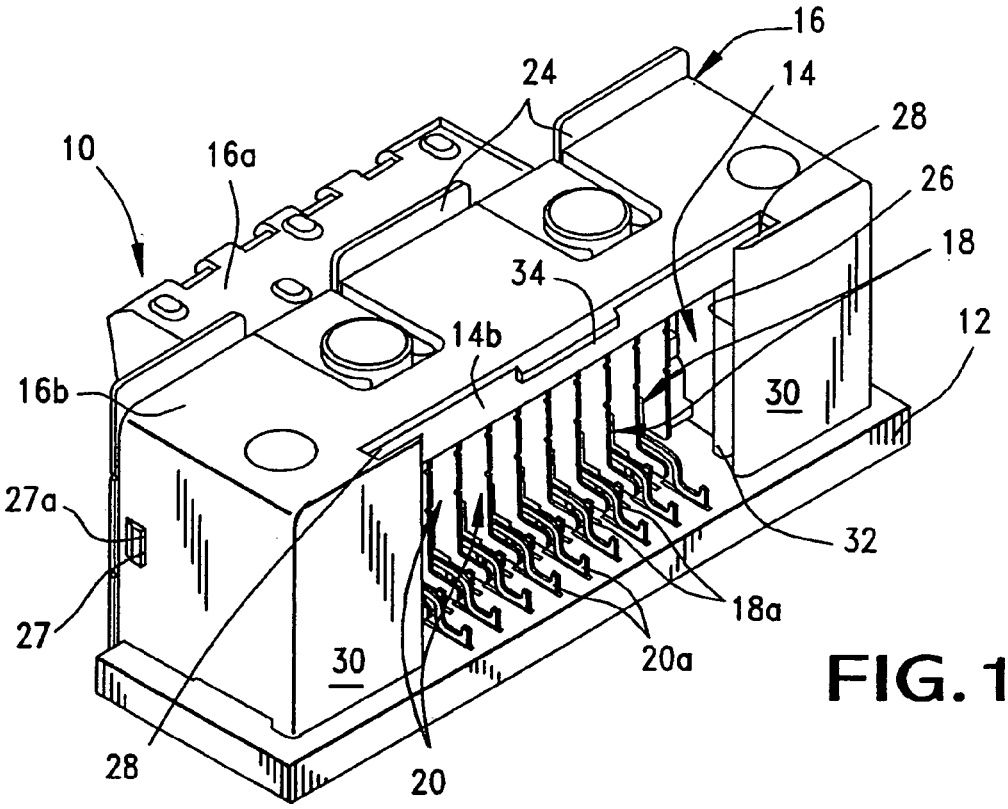
FIG. 1 is a rear perspective view of a shielded electrical connector mounted on a printed circuit board and with the shield cover of the invention removed to facilitate the illustration.

Referring to the drawings in greater detail, and first to FIG. 1, the invention is embodied in a shielded electrical connector, generally designated 10, for mounting on a printed circuit board 12. The connector includes an inner dielectric housing, generally designated 14, and an outer metal shield, generally designated 16 which substantially surrounds the housing. A plurality of signal terminals, generally designated 18, are mounted on the housing, and a plurality of ground terminals, generally designated 20, also are mounted on the housing. The signal and ground terminals alternate along the connector. Signal terminals 18 have tail portions 18*a* which are connected, as by soldering, to appropriate signal circuit traces on printed circuit board 12. Ground terminals 20 have tail portions 20*a* for connection, as by soldering, to appropriate ground traces on the circuit board.

Figure 6:
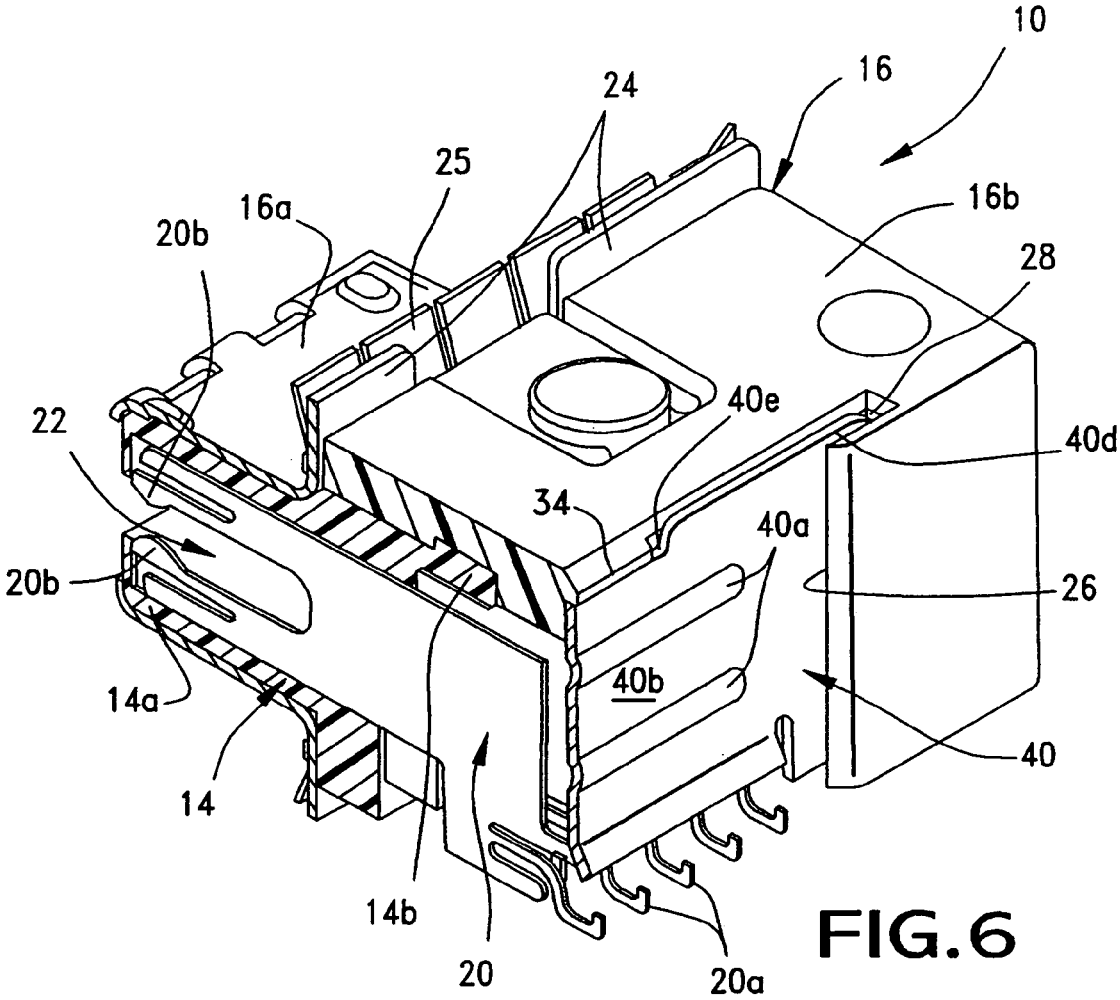
FIG. 6 is a vertical section taken generally along line 6—6 in FIG. 3.

Referring to FIG. 6 in conjunction with FIG. 1, dielectric housing 14 has a front mating end 14*a* and a rear terminating end 14*b*. The housing may be a one-piece structure unitarily molded of dielectric material such as plastic or the like. Mating end 14*a* of the housing defines a mouth 22 (FIG. 6) for receiving a mating portion of a complementary mating connector or other connecting device. The mating device will have signal contacts and ground contacts for engaging contact portions of signal terminals 18 and ground terminals 20 exposed within mouth 22. Only contact portions 20*b* of one of the ground terminals 20 are visible in FIG. 6, it being understood that signal terminals 18 also have contact portions exposed within mouth 22 at mating end 14*a* of dielectric housing 14.

Still referring to FIGS. 1 and 6, metal shield 16 is a two-part structure including a front shield part 16*a* and a rear shield part 16*b*. The front shield part is stamped and formed of sheet metal material and is crimped about the front mating end 14*a* of housing 14 to surround the mating end of the housing and shield the mating interface with the complementary mating connector. The front shield part has outwardly projecting flanges 24 for abutting against the front of rear housing part 16*b*. The rear shield part is a die-cast component fabricated of such material as zinc with a nickel plating. The rear shield part is assembled to inner housing 14 by means of a pair of openings 27 (FIG. 1) in opposite sides of the rear shield part snap-fit over a pair of latch bosses 27*a* projecting outwardly from the inner housing. The mating end of the connector may be inserted through an opening in a panel, and an elastomeric gasket 25 may be disposed about the front shield part in front of flanges 27.

Rear shield part 16*b* of metal shield 16 includes an inspection opening 26 to allow for visible inspection of the solder connections between tail portions 18*a* and 20*a* of signal terminals 18 and 20, respectively, and their respective circuit and ground traces on printed circuit board 12. A pair of grooves 28 are formed immediately inside the outer sides of inspection opening 26. Grooves 28 are formed between rear walls 30 of rear shield part 16*b* and a rear face 32 of housing 14. In essence, grooves 28 form a vertical (as viewed in the drawings) slot for receiving a shield cover (described hereinafter) which can close inspection opening 26. Finally, a latch tab 34 projects rearwardly of rear shield part 16*b* at the top thereof and at the top of the vertical slot defined by grooves 28.

Figure 2:
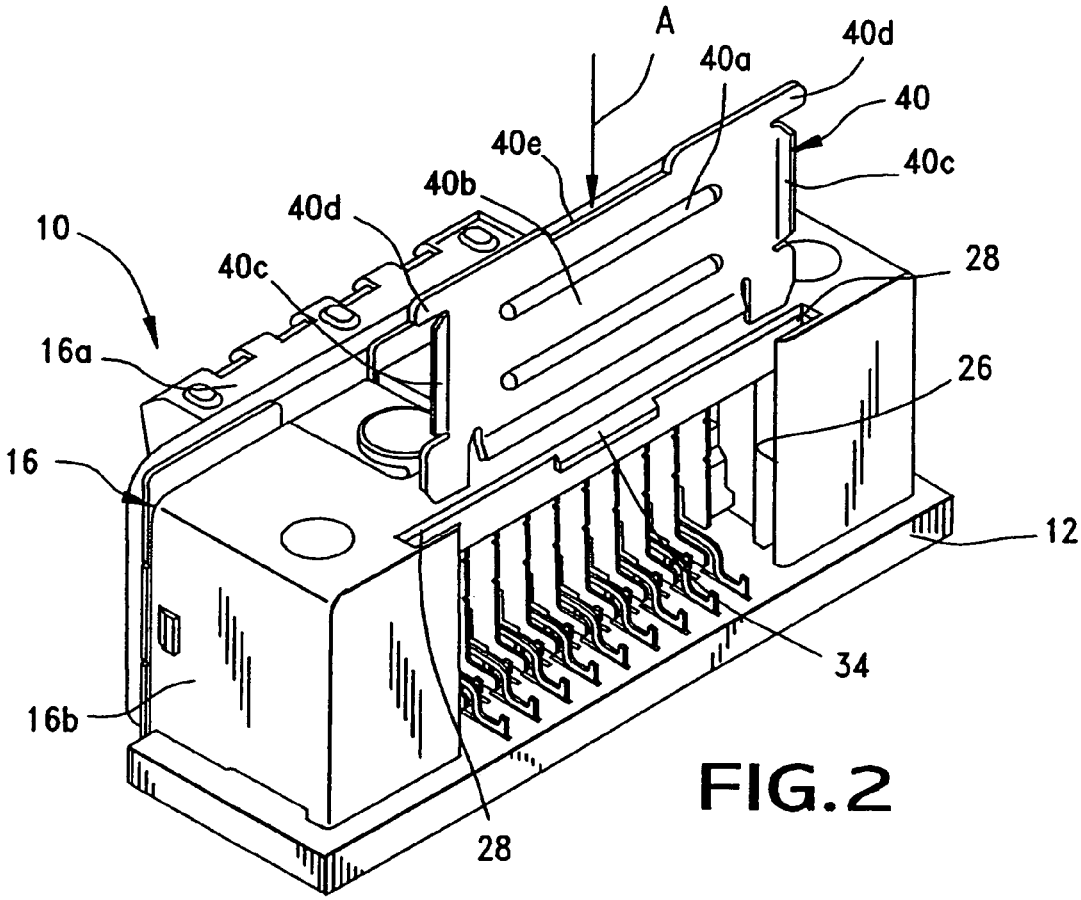
FIG. 2 is a view similar to that of FIG. 1, with the shield cover lifted above the connector.
Figure 3:
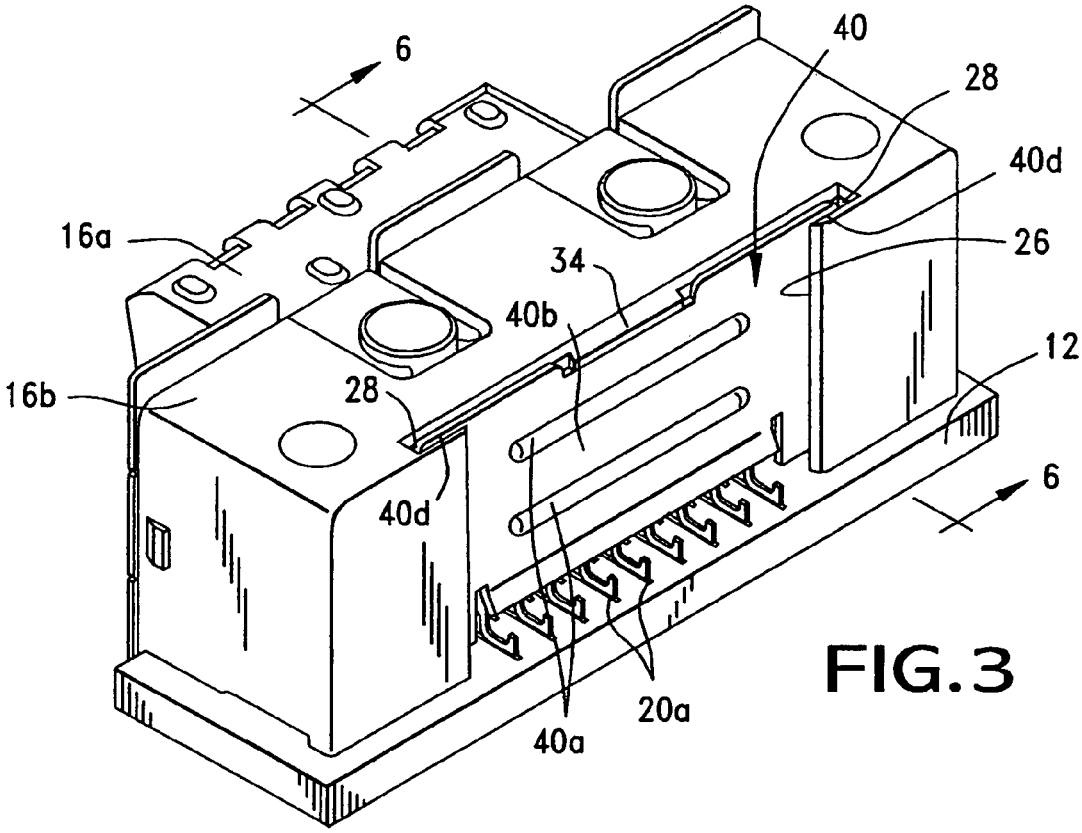
FIG. 3 is a view similar to that of FIG. 2, with the shield cover in its closed position on the connector.
Figure 4:
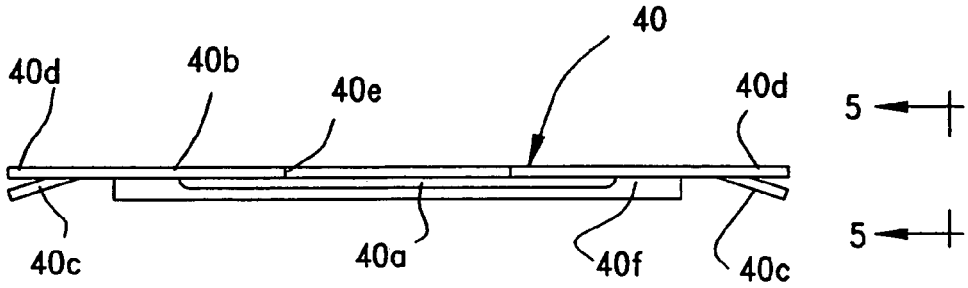
FIG. 4 is a top plan view of the shield cover.
Figure 5:
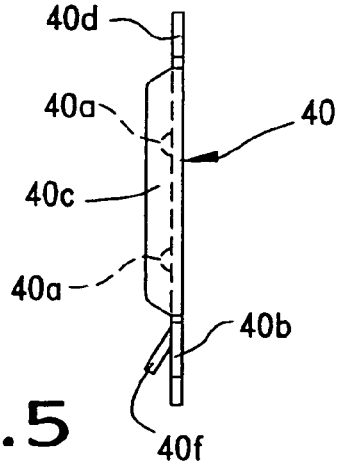
FIG. 5 is an end Elevational view of the shield cover looking in the direction of line 5—5 in FIG. 4.

Referring to FIGS. 2 and 3, the invention contemplates the provision of a shield cover, generally designated 40, for closing inspection opening 26 and provide EMI protection at the rear terminating area of connector 10. The shield cover is shown in FIG. 2 in an open position about to be inserted into grooves 28 in the direction of arrow "A" generally perpendicular to printed circuit board 12. FIG. 3 shows the shield cover fully inserted into grooves 28 and closing inspection opening 26. The shield cover is a one-piece, generally planar structure which may be stamped and formed of sheet metal material. A pair of reinforcing ribs 40*a* are stamped out of a planar body 40*b* of the cover to prevent the cover from bending. A pair of spring tabs 40*c* are bent out of the plane of body 40*b* at the side edges thereof as can be seen best in FIGS. 4 and 5. The spring tabs positively engage rear walls 30 of rear shield part 16*b* to improve the electrical interengagement between the shield cover and metal shield 16.

Generally, stop means are provided to limit the depth of insertion of shield cover 40 into grooves 28. In other words, the stop means define the closed position of the cover as shown in FIG. 3, with the cover maintained above printed circuit board 12. More particularly, a pair of stop tabs 40*d* project outwardly from opposite top corners of the shield cover as can be seen clearly in FIG. 2. These stop tabs abut against top surfaces of the inner dielectric housing 14 within grooves 28. The stop tabs define the closed position of shield cover 40 as seen in FIG. 3, with the cover as close to printed circuit board 12 as possible but not to become engaged with tail portions 20*a* of ground terminals 20, as will be described in greater detail hereinafter.

Generally, latch means are provided to hold shield cover 40 in its closed position, closing inspection opening 26 in the rear shield part 16*b* of metal shield 16. Specifically, a latch recess 40*e* is stamped in the top edge of shield cover 40. Latch tab 34 at the top rear edge of the rear shield part 16*b* is chamfered. Therefore, as shield cover 40 is inserted into grooves 28 in the direction of arrow "A" (FIG. 2), chamfered latch tab 34 slightly bends the planar body portion 40*b* of the shield cover rearwardly as the cover moves downwardly to its closed position shown in FIG. 3. When the cover reaches its closed position, latch tab 34 "snaps" into engagement within latch recess 40*e* at the top edge of the cover to hold the cover in its closed position.

Figure 7:
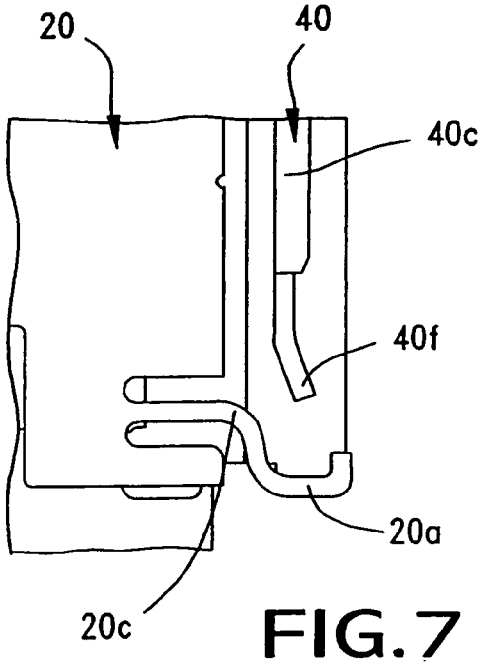
FIG. 7 is an enlarged, fragmented elevational view looking at the bottom edge of the shield cover in relation to the bottom rear corner of one of the ground terminals of the connector.

Finally, FIG. 7 shows that a bottom edge 40*f* of shield cover 40 is flared outwardly or rearwardly. This prevents the shield cover from engaging any portions of ground terminals 20 which project rearwardly at the bottom of the connector, such as elbow portions 20*c* of the ground terminals which lead to tail portions 20*a*. By flaring the bottom edge of the shield cover, the shield cover can be inserted as close to printed circuit board 12 as possible to provide good EMI protection when closing inspection opening 26. By inserting the shield cover in a vertical direction, as viewed in the drawings, generally perpendicular to printed circuit board 12, there is no lost space or "real estate" behind the connector above the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector for mounting on a printed circuit board, comprising:

a dielectric housing for mounting on the printed circuit board and including a front mating end and a rear terminating end;

a plurality of conductive terminals mounted on the housing and including contact portions at the mating end of the housing for engaging appropriate contacts of a complementary mating connector and tail portions at the terminating end of the housing for connection to appropriate circuit traces on the printed circuit board;

a metal shield about at least portions of the dielectric housing, the shield having an opening at the rear of the housing to afford visual inspection of the connections between the tail portions of the terminals and the circuit traces on the circuit board; and a shield cover slidably mounted at the rear of the housing and the metal shield to slidably close the opening in the metal shield in a direction generally perpendicular to the printed circuit board.

2. The shielded electrical connector of claim 1, including grooves at opposite sides of said opening for slidably receiving opposite side edges of the shield cover.

3. The shielded electrical connector of claim 2 wherein said grooves are formed between the housing and the metal shield.

4. The shielded electrical connector of claim 2 wherein said shield cover includes spring tabs at said opposite side edges thereof for positively engaging the metal shield to improve electrical interengagement therewith.

5. The shielded electrical connector of claim 2 wherein said shield cover includes stop means to limit the depth of insertion of the cover into the grooves.

6. The shielded electrical connector of claim 5 wherein said stop means include laterally extending stop tabs for engaging one of the housing or the metal shield to define the depth of insertion of the shield cover into the grooves.

7. The shielded electrical connector of claim 1 wherein said shield cover includes stop means to define a closed position of the shield cover above the printed circuit board.

8. The shielded electrical connector of claim 1, including latch means to hold the shield cover in position closing said opening in the metal shield.

9. The shielded electrical connector of claim 8 wherein said latch means comprise interengaging latch means between the shield cover and the metal shield.

10. The shielded electrical connector of claim 9 wherein said latch means include a latch tab on the metal shield projecting over a top edge of the shield cover.

11. The shielded electrical connector of claim 1 wherein said bottom edge of said shield cover is flared outwardly to prevent engagement of the cover with an portions of any terminals mounted in the connector.

12. A shielded electrical connector for mounting on a printed circuit board, comprising:

a dielectric housing for mounting on the printed circuit board and including a front mating end and a rear terminating end;

a plurality of conductive terminals mounted on the housing and including contact portions at the mating end of the housing for engaging appropriate contacts of a complementary mating connector and tail portions at the terminating end of the housing for connection to appropriate circuit traces on the printed circuit board;

a metal shield about at least portions of the dielectric housing, the shield having an inspection opening at the rear of the housing to afford visual inspection of the connections between the tail portions of the terminals and the circuit traces on the circuit board;

a pair of grooves at opposite sides of said inspection opening and extending generally perpendicular to the printed circuit board;

a metal shield cover having opposite side edges slidably mounted in said grooves to close the inspection opening in a direction generally perpendicular to the printed circuit board, the shield cover including spring tabs at said opposite side edges thereof for positively engaging the metal shield to improve electrical interengagement therewith;

stop means to limit the depth of insertion of the cover into the grooves; and latch means to hold the shield cover in position closing said opening in the metal shield.

13. The shielded electrical connector of claim 12 wherein said grooves are formed between the housing and the metal shield.

14. The shielded electrical connector of claim 12 wherein said stop means include laterally extending stop tabs for engaging one of the housing or the metal shield to define the depth of insertion of the shield cover into the grooves.

15. The shielded electrical connector of claim 12 wherein said latch means comprise interengaging latch means between the shield cover and the metal shield.

16. The shielded electrical connector of claim 15 wherein said latch means include a latch tab on the metal shield projecting over a top edge of the shield cover.

17. The shielded electrical connector of claim 12 wherein said bottom edge of said shield cover is flared outwardly to prevent engagement of the cover with an portions of any terminals mounted in the connector.

18. The shielded electrical connector of claim 12 wherein said shield cover is stamped and formed of sheet metal material.

* * * * *